United States Patent [19]

Banks et al.

[11] Patent Number: 4,751,747

[45] Date of Patent: Jun. 21, 1988

[54] FINGER AND THUMB HEAT PROTECTOR

[76] Inventors: Janice Banks; Mark Bradford, both of 1301 Michigan Ave., Apt. #3, Santa Monica, Calif. 90404

[21] Appl. No.: 118,731

[22] Filed: Nov. 9, 1987

Related U.S. Application Data

[63] Continuation-in-part of Ser. No. 878,071, Jun. 24, 1986, abandoned.

[51] Int. Cl.[4] ..... A41D 19/00

[52] U.S. Cl. ..... 2/21; 2/161 R

[58] Field of Search ..... 2/16.20, 21, 159, 161 R, 2/161 A, 163, 164, 167, 169; 132/1 R

[56] References Cited

U.S. PATENT DOCUMENTS

| | | | |
|---|---|---|---|
| 527,704 | 10/1894 | Merrill | 2/163 |
| 1,362,461 | 12/1920 | Anast | 2/21 |
| 1,483,595 | 2/1924 | Read | 2/161 A |
| 1,913,218 | 6/1933 | Smith | 2/21 |
| 2,025,710 | 12/1935 | Beemer | 2/20 X |
| 2,068,182 | 1/1937 | Jackson | 2/20 |
| 2,069,449 | 2/1937 | Jensen | 2/20 |
| 2,351,906 | 6/1944 | Beatty | 2/21 |
| 2,391,263 | 12/1945 | Morton | 2/20 |
| 2,447,951 | 8/1948 | Lindfelt | 2/167 |
| 2,907,046 | 10/1959 | Scherr | 2/167 X |
| 4,025,962 | 5/1977 | Hartung | 2/161 A |
| 4,573,220 | 3/1986 | Baker | 2/21 X |
| 4,689,828 | 9/1987 | Brewer | 2/21 |

FOREIGN PATENT DOCUMENTS

| | | | |
|---|---|---|---|
| 2722429 | 11/1978 | Fed. Rep. of Germany | 2/164 |
| 1369291 | 6/1964 | France | 2/21 |

OTHER PUBLICATIONS

"A Dictionary of Textile Terms", Dan River, Inc., 1976; pp. 30 and 39.

"Introductory Textile Science", 3rd Ed, Marjory Joseph Holt, Rinehart and Winston, 1977 pp. 239, 240, 256–258.

*Primary Examiner*—Louis K. Rimrodt

*Attorney, Agent, or Firm*—Albert O. Cota

[57] ABSTRACT

The object of the invention is to provide thermal protection to the fingers and thumb of a beautician while using a heated hair curling iron. A pair of finger encompassing sheaths (20) and a thumb sheath (28) are connected together with an insulating base structure (22) forming a bridge therebetween. Finger and thumb pads (24) and (30), along with cloth lining (36), provide the insulation and structure while stretchable fabric (26) for the fingers (32) and for the thumb complete the protector holding the device upon the operators hand, allowing complete and unhampered flexibility.

7 Claims, 1 Drawing Sheet

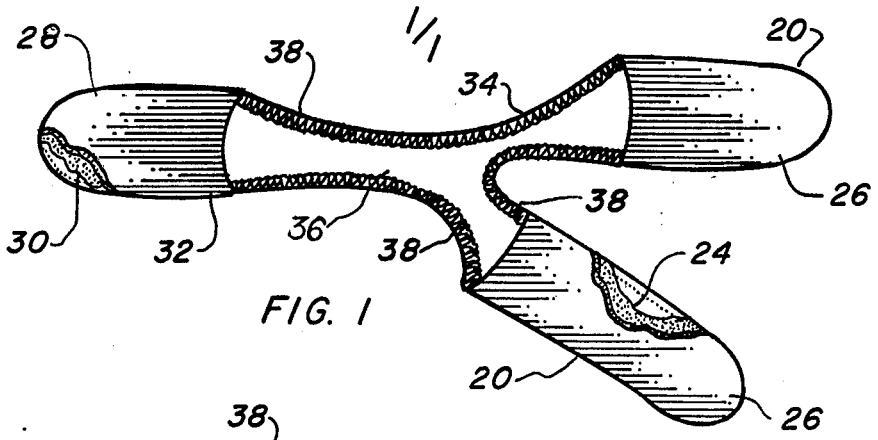
FIG. 1
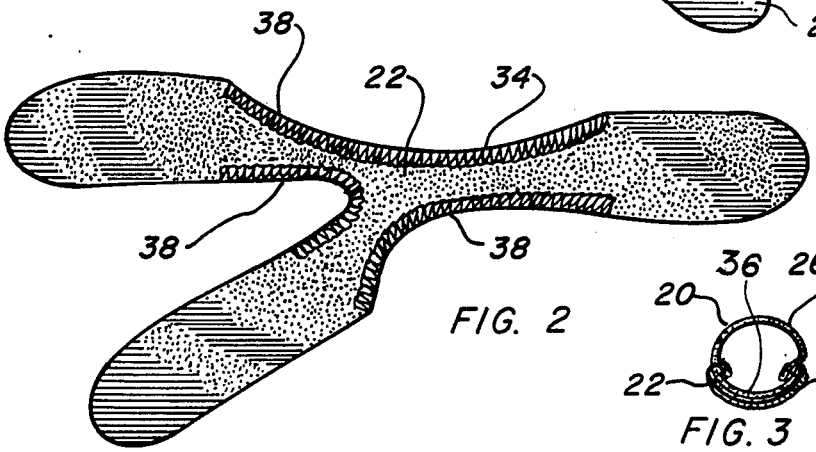
FIG. 2
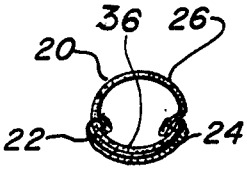
FIG. 3
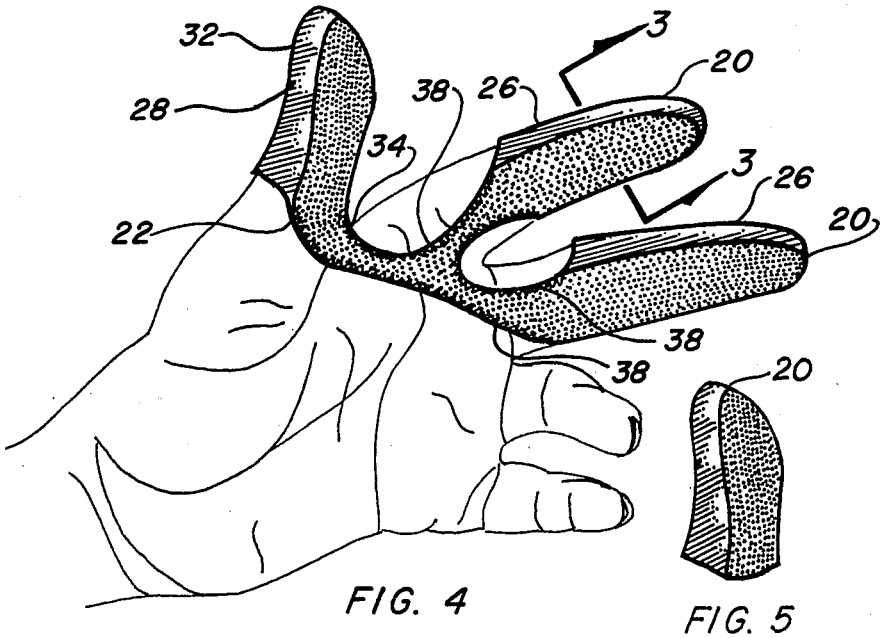
FIG. 4
FIG. 5

FINGER AND THUMB HEAT PROTECTOR

This application is a continuation-in-part of application Ser. No. 878,071 filed June 24, 1986 now abandoned.

TECHNICAL FIELD

The present invention relates to finger protection in general, and more specifically to a device that encompasses two fingers and the thumb with a web bridge therebetween having thermal insulating properties allowing use with hot curling irons incidental with hair dressing.

BACKGROUND ART

Gloves have been in use to protect one's hands from abuse for centuries and have been constructed with a myriad of materials, some of which afford a degree of protection from heat. Specialty vocational tools, however, create problems not solved by the use of simple gloves that are well known in the art. Addition of subsequent material in appropriate areas have been attempted to protect from the heat and even rubber pads have been in use to protect one's fingers from sharp particles held by the hand.

A search of the prior art did not disclose any patents that read directly on the claims of the instant invention, however, the following U.S. patents were considered related:

| PATENT NO. | INVENTOR | ISSUE DATE |
|---|---|---|
| 4,186,442 | Kilgore | Feb. 5, 1980 |
| 4,032,990 | Mandlman | July 5, 1977 |
| 3,928,871 | Wall | Dec. 30, 1975 |
| 2,827,635 | Rasmus | Oct. 24, 1955 |
| 2,391,851 | Willard | Dec. 25, 1945 |
| 2,907,046 | Scherr | Oct. 6, 1959 |
| 2,069,449 | Jensen | Feb. 2, 1937 |
| 1,369,291 (France) | Bossard | Sep. 17, 1963 |

Mandlman practices a heat resistant glove for use in foundries when handling extremely hot objects, such as molten metal, ladles, or the like. The glove covers the entire hand and wrist and contains an insulating portion which fits between the liner of the glove and the outside portion. This insulation is formed as a double pocket allowing insertion therebetween during the manufacturing process. This additional insulation protects the thumb and forefinger and requires no extra sewing or connecting means during the normal assembly procedure.

Jensen teaches a hand protector made of sheet rubber formed with a pouch-like portion to more or less snugly receive the end portions of the four fingers of one hand like a mitten. A web or flexible connecting portion continues into a tapered cot in which the thumb is placed. As the material is rubber, the cutting operation causes the adjoining edges to adhere and when cured are sealed and locked together. The device further contains a metal clip at the sheet side for attaching a pad of abrasive material. The material, being rubber, is stretchable on both sides, but does not possess a particularly low coefficient of heat transfer.

Willard provides a protective glove for the second and third fingers, as well as the thumb. The fingers and thumb portions are attached with a palm section and a wrist band holds the device securely to the hand. A cloth backing is provided on the finger sheaths. One piece construction of the palm and finger sections extent from the wrist to the tips of the fingers and form two sides of the fingers with fourchettes, thereby eliminating seams that allow the fingers to fit into a bowling ball without obstructions.

Scherr teaches a five fingered glove with a single pice of thin pliable leather attached to the palm of the glove by a row of sewn stitches which extend around the outer periphery of the palm. The leather provides a frictional gripping and wear resistant surface on the inner portion of the glove.

The French patent issued to Bossard indicates a single multiple fingered glove with a increased thickness of heat resistant plastic on the gripping surface of the fingers and thumb. A sheath of the same material except thinner joins the fingers together however, no bridge therebetween is specifically taught and the material is resilient allowing a fit onto the fingers as well as conforming to the palm of the hand.

For background purposes and as indicative of the art to which the invention relates, reference may be made to the remaining cited patents.

It will be noted, however, that the teaching of prior art for gloves and pouches while providing some protection do not specifically allow all of the requisites necessary to be used by cosmetologists in the preparation of the hair when using heat producing instruments.

DISCLOSURE OF THE INVENTION

Hair dressing is an art that is learned through basic instruction, but mostly through experience and, like any art form, allows creativity in the precise details of the positioning and curvature of the hair. In order to originate such an arrangement, the manual dexterity of the operator is of prime importance. The problem has existed in the past that while curling the hair with the use of heat applying instruments such of the precision is lost. In order to curl the hair effectively, the hair dresser must manually position the hair directly upon the heat source. This procedure is best accomplished while the instrument is at an elevated temperature, that can exceed 400° F., to allow individual hair strands to be reshaped, changing the overall direction orientation. As the instruments are normally heated in a small electric stove and are hot enough to produce severe damage to the flesh, extreme care must be taken to avoid touching the heated portion. Difficulty is then encountered manipulating every hair in the proper direction while protecting the fingers with such great care. Gloves are of no help whatsoever, as the requisite dexterity is completely lost and separate pads or protective devices are also useless in the exact precision required.

It is, therefore, a primary object of the invention to be able to maintain complete freedom of movement of the hand while having heat resistant material strategically located on two fingers and the thumb. The only areas that normally come in contact with the heat are limited to the inside surface of the first and second fingers and the adjoining thumb. The balance of the hand is completely unaffected and should not be encumbered with any extraneous structure. The use of this device, therefore, solves the long felt need for such portection in this feld of endeavor.

An important object of the invention provides a safety measure. Inasmuch as the normal operation does not include the necessity of touching the web between the fingers and thumb to the heated instrument, no insulation by itself is required. It is possible, however, to accidently touch this area in specific angular manipulations, therefore, the connecting link between the fingers and thumb becomes a cradle and holds the hand away from the heat source without becoming large and bulky by itself. Since the prime function of the invention is to protect without limiting hand movement, this object furthers the scope, but not at the expense of the utility.

Another object of the invention provides a comfortable fit on the fingers that is tight enough to hold securely, but not restrictive in nature. This is accomplished by the use of so called double knit fabric on the back side of the fingers and thumb. Not only does this provide a pleasing fit, but allows one universal size to fit most hands. The conforming nature of the insulation also adds to the comfort as the material utilized is a double layer of felt with a cloth fabric overcover. This also conforms to the working portion of the finger and thumb minimizing the bulk while optimizing the thermal conductivity of the protective area.

Still another object of the invention leaves the balance of the hand free of any encumberances, such as straps, wrist bands, elastic interconnection, or the like. The device does not even resemble a glove, as again the prime purpose is to allow freedom of movement while providing as limited structure as possible.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 1 is a plan view of the preferred embodiment viewed from the back.

FIG. 2 is a plan view of the preferred embodiment viewed from the front.

FIG. 3 is a cross-sectional view taken along lines 3—3 of FIG. 4.

FIG. 4 is a partial isometric view of the preferred embodiment shown in place on the operator's hand.

FIG. 5 is a isometric view of a finger glove.

BEST MODE FOR CARRYING OUT THE INVENTION

The best mode for carrying out the invention is presented in terms of a preferred embodiment. The preferred embodiment, as shown in FIGS. 1 through 4 is comprised of a pair of finger encompassing sheaths 20 that stretchably envelope the forefinger and middle finger of the hand. These sheaths 20 consist of a double thickness of thermal insulting material on the side planar to the palm of the hand. This insulating material is made of a composition of wool fibers rolled and pressed together into a cloth designated commonly as felt illustrated with a dotted texture in FIGS. 1, 2 and 4. A stretchable fabric portion 26 is attached on the opposite side and is configured to retain the sheath 20 upon the fingers through the tension of the material itself. The preferred stretchable fabric 26 is a double knit cloth made with two sets of needles in a double thickness arrangement. While this material is preferred, other substances may be incorporated with equal ease as long as it possesses elastic properties compatible with the application.

A thumb encompassing sheath 28 stretchably surrounds the thumb of the operator's hand, having the same base structure 22 as the finger sheath and a thumb pad 30, also of felt shown with a dotted texture in FIG. 1. The sheath 28 includes identical stretchable fabric 32, except it is configured to fit the thumb. The material and function of the thumb sheath 28 is basically a duplicate of the finger sheath 20.

A narrow bridge 34 is a continuation of the base insulating structure 22 in both fingers and the thumb and is of one integral piece of insulating material that connects the elements together. This bridge 34 is much narrower than the fingers or thumb portion, as it serves two functions. First, it is the connecting link joining the fingers to the thumb for convenience making a one-piece device, and second, the bridge 34 creates a web-like structure that keeps the heated instrument from contacting the hand. While the configuration is narrow enough to be out of the way and not affect the movement of individual fingers, its presence is utilized for this protective function.

A tightly woven cloth lining 36 is juxtapositioned upon the thermal insulating base structure 22 on the side contiguous with the palm of the hand. This lining 36 provides the structural integrity to hold the shield together and affords the durability and strength to prolong the life under normal operating conditions.

All of the elements of the shield are attached together by sewing collectively with thread 38. The base insulating structure 22 is placed flat with the finger pads 24 and thumb pad 30 located in the approximate areas. The cloth lining 36 is then laid on the top covering the pads 24 and 30. The stretchable fabric 26 and 32 is located over the finger and thumb sections with the portion that the digit enters folded over to create a double closed edge. The fingers and thumb are then sewn together on the three edges leaving the side facing each other open for use. The space between the pads 24 and 30 is sewn with an overcast stitch connecting the base insulating structure 22 with the cloth lining 36. The finger and thumb stretchable fabric 26 and 32 are then reversed inside out concealing the stitching completely.

In operation the protecting shield is placed on the hairdressers hand, either right or left, according to the convenience of the user. In one hand the operator holds the curling iron, or other heated hair care instrument, while the hand with the protector controls the formation and direction of the curl. Further, when pressing the hair with a hot pressing comb, the fingers may be held close together and placed under the hair enabling a comfortable method for pressing the ends of the hair.

While the invention has been described in complete detail and pictorially shown in the accompanying drawings, it is not to be limited to such details, since many changes and modifications may be in the invention without departing from the spirit and the scope thereof. For example, an upper section of the finger encompassing sheath 20 or thumb 28 may be cut from the finger and thumb protector to serve as an individual finger glove as shown in FIG. 5. One or more of these finger gloves may then be used, as required, to protect the fingers while cutting or curling hair under heat. Hence, it is described to cover any and all modifications and forms which may come within the language and scope of the appended claims.

We claim:

1. A three fingered heat protecting bridge to shield the hand of a beautician comprising:

(a) a pair of finger encompassing sheaths having a stretchable back that extendably envelope the forefinger and middle finger of one's hand further having thermal insulating material on the side planar to the palm of the hand and a stretchable fabric on the remaining back portion configured in such a manner as to grippingly maintain the sheath upon the fingers of one's hand when placed thereupon through the retractable nature of the stretch fabric, (b) a thumb encompassing sheath that stretchably surrounds the thumb of one's hand having thermal insulating material on the same side as the palm of the hand and stretchable fabric on the remaining portion configured in such a manner as to grippingly maintain the sheath upon the thumb of the hand when placed thereupon characterized by the retractable nature of the stretch fabric, and, (c) a narrow bridge of thermal insulating material integral with, and connected to said finger and thumb encompassing sheaths, forming an insulating web therebetween, which does not impede the movement of the fingers allowing a hot hair curling iron to be handled without burning the hand contiguously engaging the iron while manipulating hair around the iron during the process of hair curling by a beautician.

2. The invention as recited in claim 1 wherein said thermal insulating material comprises a felt composition of wool fibers rolled and pressed together into a cloth.

3. The invention as recited in claim 1 further comprising a double thickness of thermal insulting material in the finger and thumb sheaths.

4. The invention as recited in claim 1 wherein said thermal insulating material further comprises a finger and thumb pad along with said bridge of insulating material in two separated masses each having a boundary layer by itself providing insulation and structural integrity for the heat protecting device.

5. The invention as recited in claim 1 wherein said stretchable fabric further comprises a double knit cloth made with two sets of needles producing a double thickness of material.

6. The invention as recited in claim 1 wherein the elements are sewn together by stitching with thread.

7. The invention as recited in claim 1 wherein a single section of said finger encompassing sheath is cut from said finger and thumb protector to serve as a finger glove while cutting or curing hair under heat.

* * * * *